US005379817A

United States Patent [19]

O'Neil et al.

[11] Patent Number: 5,379,817

[45] Date of Patent: Jan. 10, 1995

[54] SHARPENER FOR A SOFT ELEMENT PENCIL

[76] Inventors: Edmund O'Neil, 25 Scrivens St., Totowa, N.J. 07512; Vincent Pace, 465 Long Hill Dr., Short Hills, N.J. 07078

[21] Appl. No.: 205,081

[22] Filed: Mar. 3, 1994

[51] Int. Cl.[6] ..... B43L 23/00; B27M 1/00

[52] U.S. Cl. ..... 144/363; 30/453; 30/454; 30/457; 144/28.2; 144/28.4; 144/28.5; 144/28.6

[58] Field of Search ..... 144/28.2–28.9, 144/30; 30/451, 453–457

[56] References Cited

U.S. PATENT DOCUMENTS

| | | | |
|---|---|---|---|
| 715,849 | 12/1902 | Oliver . | |
| 1,121,423 | 12/1914 | Van Norden et al. . | |
| 1,887,843 | 11/1932 | Ludwig . | |
| 2,626,593 | 1/1953 | Gwin, Jr. . | |
| 3,059,617 | 10/1962 | Swimmer et al. . | |
| 3,090,358 | 5/1963 | Condon . | |
| 3,097,629 | 7/1963 | Fleming et al. . | |
| 3,115,869 | 12/1963 | Freeman . | |
| 3,175,539 | 3/1965 | Saflund et al. . | |
| 3,659,637 | 5/1972 | Condon . | |
| 4,050,487 | 9/1977 | Mabuchi et al. | 144/28.5 |
| 4,231,405 | 11/1980 | Vila | 144/28.4 |
| 4,248,283 | 2/1981 | Kaye . | |
| 4,402,354 | 9/1983 | Halpern . | |
| 5,167,071 | 12/1992 | Eisen | 30/452 |

*Primary Examiner*—W. Donald Bray
*Attorney, Agent, or Firm*—Thomas L. Adams

[57] ABSTRACT

A sharpener for a soft element pencil has a housing with a pencil hole. A rotor rotatably mounted in the housing has: (a) a base portion, (b) an annular portion spaced from said base portion, and (c) a blade supported at but not between the base and the annular portion. The sharpener has a motor mounted in the housing for revolving the rotor. The blade has a skewed cutting edge that revolves around a conical axis to follow and cut a conical surface. In use, a cosmetic pencil or artist's pencil can be inserted against the blade when the blade is revolved by the motor. The pencil can then be removed and applied facially. The cosmetic pencil can then be reinserted against the blade when the cosmetic pencil is dull. Thereafter the cosmetic pencil is reapplied facially.

27 Claims, 2 Drawing Sheets

SHARPENER FOR A SOFT ELEMENT PENCIL

BACKGROUND OF THE INVENTION

1. Field of the Invention

The present invention relates to sharpeners, and in particular, to motor driven sharpeners for soft pencils.

2. Description of Related Art

Cosmetic pencils and artists' pencils employ a relatively soft core. These pencils must be frequently sharpened when in use. For example, a cosmetologist may need to sharpen a pencil ten or more times during a single session with a customer.

Sharpeners for soft pencils are typically manual. Such sharpeners employ a frame having a conical cavity. The conical cavity has a slit that is partially covered by a blade. A pencil is sharpened by rotating the frame and its blade around the point of a pencil. Manual devices for sharpening cosmetic pencils are shown in U.S. Pat. Nos. 3,097,629; 4,248,283; 4,402,354; and 5,167,071.

Known motor driven sharpeners employ conical barrels with splined exteriors. These sharpening cones grind the pencil point. Such grinding is inappropriate for a soft element pencil such as a cosmetic or artist's pencil, because the grinding produces a roughened, unusable surface.

For a motor driven blade to work satisfactorily with a soft element pencil, the blade must be open, exposed and relatively free from obstructions. If the motor driven blade is mounted on a frame adjacent a slot of a conical cavity, the soft core shavings will quickly clog the slot.

The sharpener in U.S. Pat. No. 3,059,617 has a blade holder that is spun by an electric motor. The blade in this reference is shut in and relatively obstructed. Thus this blade holder will tend to clog when sharpening soft pencils. See also U.S. Pat. Nos. 1,887,843; 3,175,539, and 4,050,487.

Various other pencil sharpeners are shown in U.S. Pat. Nos. 715,849; 1,121,423; 2,626,593; 3,090,358; 3,115,869; 3,659,637; and 4,231,405.

Accordingly, there is a need for an improved sharpener for a soft element pencil such as a cosmetic or artist's pencil that operates efficiently and without clogging or grinding.

SUMMARY OF THE INVENTION

In accordance with the illustrative embodiments demonstrating features and advantages of the present invention, there is provided a sharpener for a soft element pencil. The sharpener has a housing with a pencil hole. Also, a rotor is rotatably mounted in the housing and has: (a) a base portion, (b) an annular portion spaced from the base portion, and (c) a blade supported at but not between the base and the annular portion. The sharpener has a drive means mounted in the housing for revolving the rotor. The blade has a skewed cutting edge that revolves around a conical axis to follow and cut a conical surface.

In accordance with the principles of the same invention, a method employs a cosmetic pencil together with a motor driven blade. The method includes the step of inserting the cosmetic pencil against the blade when the blade is revolved by the motor. Another step is removing the cosmetic pencil and applying the cosmetic pencil facially. The method also includes the step of reinserting the cosmetic pencil against the blade when the cosmetic pencil is dull. The method also includes the step of reapplying the cosmetic pencil facially.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
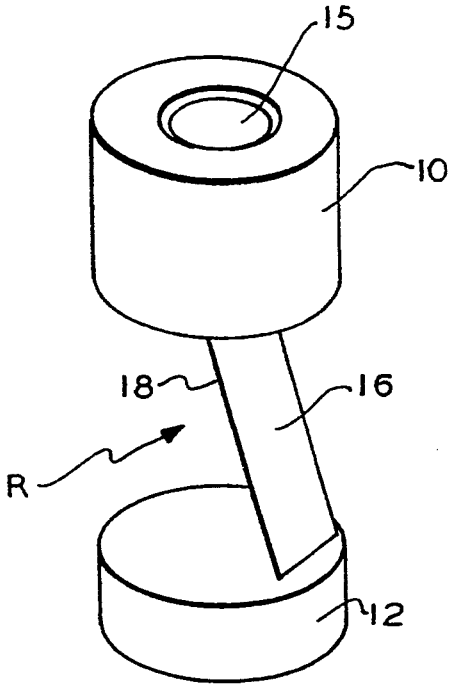
FIG. 1 is an axonometric view of a rotor for use in a sharpener according to the principles of the present invention.

Referring to FIGS. 1–6, a rotor R is shown with an annular portion 10 having outer and inner cylindrical surfaces. Annular portion 10 has a pencil aperture 15 with an upper beveled corner. A base portion 12 is shown as a cylindrical plug having a hexagonal socket 14. Connected between base portion 12 and annular portion 10 is blade 16. Blade 16 is a generally flat, plate-like structure having a beveled or chisel edge 18.

The overall length of the disclosed rotor R is 1 $\frac{3}{4}$ inches (4.5 cm), with base portion 12 being $\frac{1}{4}$ inch (0.6 cm) tall and annular portion 10 being $\frac{1}{2}$ inch (1.3 cm) tall. The outside diameter of rotor R is $\frac{5}{8}$ inch (1.6 cm), while the inside diameter of annular portion 10 is 5/16 inch (0.8 cm). It will be understood, however, that these dimensions can be varied depending upon the expected size of the pencil, and the desired structural rigidity, capacity, compactness, etc.

Figure 2:
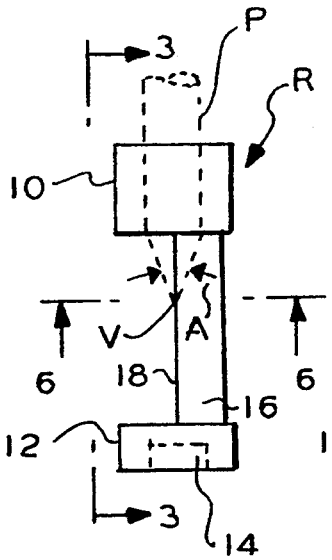
FIG. 2 is a front elevational view of the rotor of FIG. 1.

Base portion 12 and annular portion 10 are arranged coaxially, their common axis being referred to as a conical axis. Cutting edge 18 of blade 16 intersects the conical axis of rotor R. When rotor R is spun about the conical axis, the cutting edge 18 traces out a conical surface with a vertex V (FIG. 2). The conical surface subtends an angle A defined by rays from vertex V that lie on opposite sides of the conical surface.

It is preferable to have vertex V of rotor R significantly spaced from base 12. This gives a large volume of clear space for the accumulation of shavings. Vertex V is preferably designed to allow the point of pencil P to reach a quarter-way to halfway point into rotor R.

Figure 3:
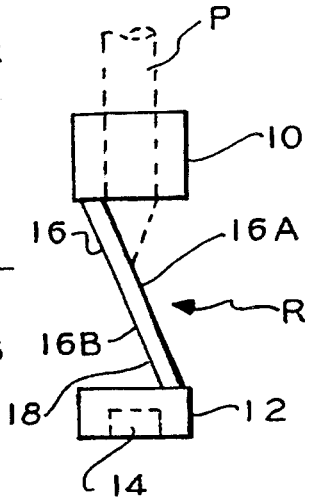
FIG. 3 is a side elevational view taken along line 3—3 of FIG. 2.
Figure 4:
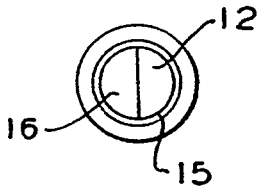
FIG. 4 is a top view of the rotor of FIG. 1.
Figure 5:
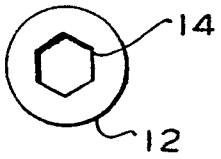
FIG. 5 is a bottom view of the rotor of FIG. 1.
Figure 6:
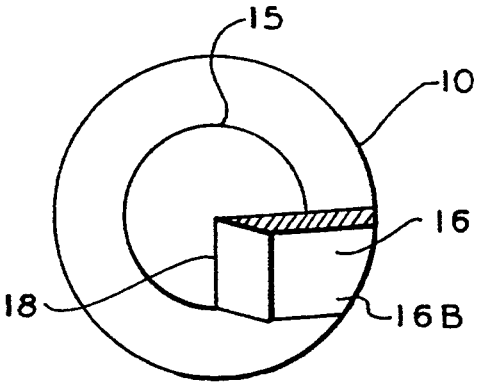
FIG. 6 is a cross-sectional view taken along line 6—6 of FIG. 2.
Figure 7:
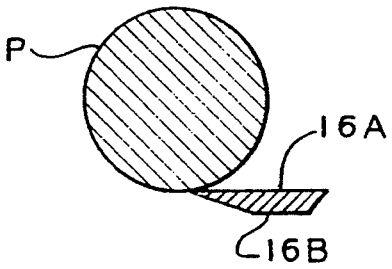
FIG. 7 is a cross-sectional view showing the blade of FIG. 1 making a tangential cut to a conical pencil surface.
Figure 8:
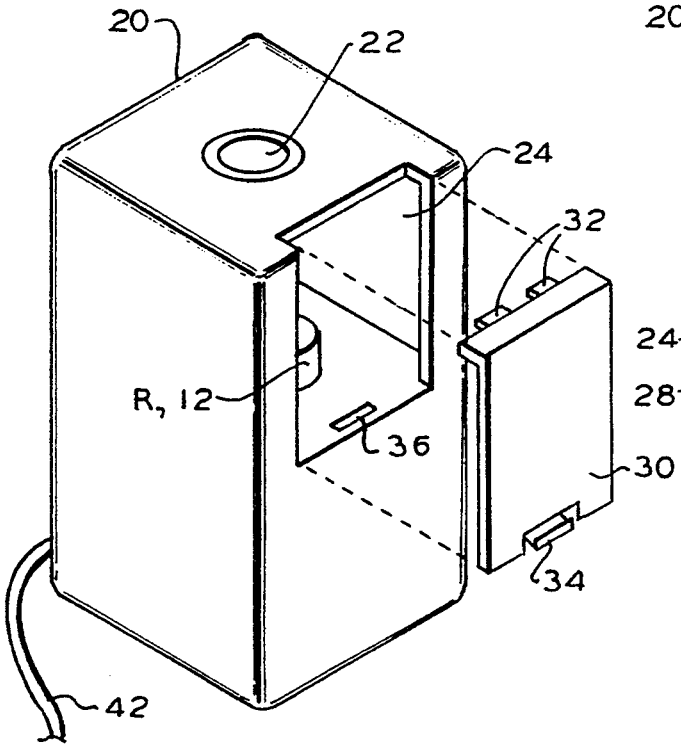
FIG. 8 is an axonometric of a sharpener according to the principles of the present invention and employing the rotor of FIG. 1.
Figure 9:
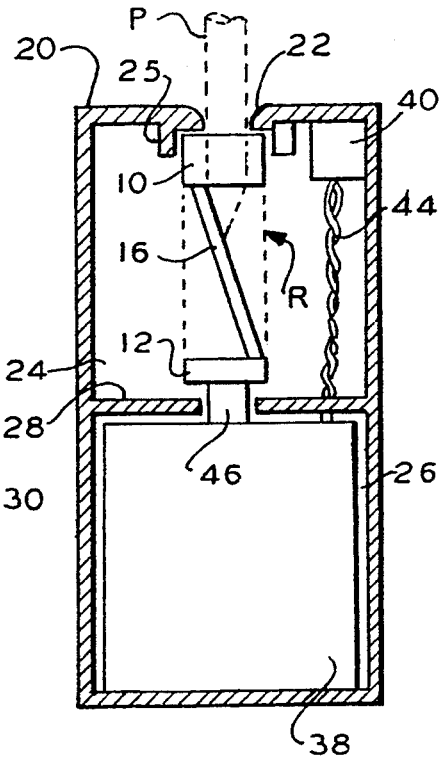
FIG. 9 is a cross-sectional view of the sharpener of FIG. 8.

When viewed on edge as in FIG. 3, blade 16 is shown as a relatively thin blade with its cutting face 16A tangential to the conical surface to be cut on pencil P. This tangency is further illustrated in FIG. 7 showing the cutting surface 16A tangent to the circumference or perimeter of pencil P.

The angle A formed by cutting blade 16 is of a size customarily used for the pencil to be sharpened, e.g., an artist's pencil or a cosmetic pencil. The angle A for this pencil point will be less than 30° and preferably about 35°, although different angles are contemplated for other pencils or for different applications.

In some embodiments, blade 16 will be ground with a bump or projection on cutting edge 18 near vertex V. This projection can allow a pencil point to be cut with a blunt tip.

In a constructed embodiment, rotor R was machined from a single piece of cylindrical steel. Thus elements 10, 12 and 16 were integral in the constructed embodiment. In other embodiments, annular portion 10 and base portion 12 can be made separately. In the latter case angled slots can be cut into the base portion 12 and annular portion 10 to receive a separate blade, which can be held in place by set screws (not shown). An embodiment with such separate components has the advantage of making the blades easier to manufacture and replaceable.

Referring to FIGS. 8–11, housing 20 is shown with an upper pencil hole 22 having a beveled rim. Pencil hole 22 has in this embodiment an inside diameter of about 7/16 inch (1.1 cm) although this dimension varies depending upon the size of pencil to be sharpened. Housing 20 has a cutting chamber 24 and a motor chamber 26. Chambers 24 and 26 are separated by partition 28. Preferably, housing 20 is 4 inches (10 cm) tall and has a width and depth both equal to 2 inches (5 cm), although these dimensions can be varied depending upon the desired capacity, cutting speed, shaving storage, etc. Also, while housing 20 is shown as rectangular, it can be made cylindrical, hemispherical, conical, pyramidical, or have other shapes.

Shavings can be removed from chamber 24 through a side opening that can be closed by access door 30. Door 30 has tabs 32 that grasp ridges (not shown) inside chamber 24. Thereafter, access door 30 can be swung into place so catch 34 can snap into aperture 36 to lock door 30 into place. In other embodiments, the top half of housing 20 can be removed to expose the rotor and to allow removal of shavings.

A drive means is shown here as an electrical motor 38 mounted in motor chamber 26. Motor 38 is connected in series with switch 40 across power line 42. A lead 44 is provided for the internal connections. Motor 38 has a drive shaft 46 that fits into previously illustrated socket (socket 14) of base portion 12.

The ceiling of cutting chamber 24 has an annular projection, herein referred to as internal collar 25. Collar 25 encircles annular portion 10 to act as a bearing and guide to stabilize rotor R and prevent wobbling.

Figure 10:
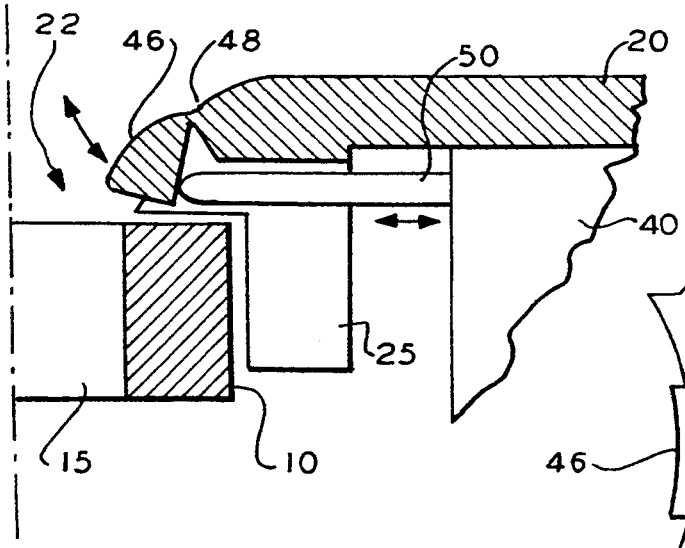
FIG. 10 is a detailed view of a switch actuator and surrounding structure at the pencil hole of the sharpener of FIG. 9.
Figure 11:
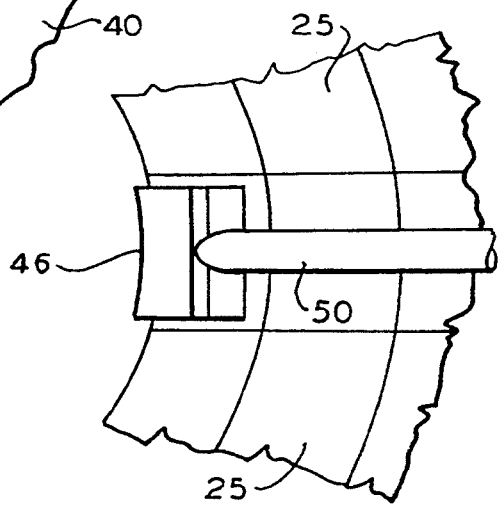
FIG. 11 is a bottom view of the switch actuator of FIG. 10.

Referring to FIGS. 10 and 11, a portion of the housing 20 is shown in detail around pencil hole 22. Hole 22 is shown with a bevelled rim. A fragment of the rim is shown as a spoke-like projection 46 that acts as a lever. Lever 46 is attached to housing 20 through a molded joint 48. This joint can bend to allow lever 46 to pivot.

A sector of internal collar 25 that is radially aligned with lever 46 is shown relieved. This relief gives clearance to actuating arm 50 of switch 40. Switch 40 is a microswitch actuated by the axial translation of its actuating arm 50. Accordingly, pressure bearing on the outside surface of lever 46 (by insertion of a pencil) causes inward rotation of lever 46, which then inwardly thrusts actuating arm 50 to operate switcn 40.

To facilitate an understanding of the principles associated with the foregoing apparatus, its operation will be briefly described. A cosmetic pencil or artist's pencil P can be inserted into pencil hole 22 (FIGS. 8 and 9) as illustrated. Upon insertion, lever 46 is depressed to actuate arm 50 and close switch 40. This supplies power to motor 38 to turn rotor R. Significantly, switch 40 closes before pencil P reaches blade 16. This allows rotor R to reach its rated speed before cutting begins. Preferably, rotor R will turn at a speed greater than 8 revolutions per minute, although the speed selected will depend upon the type of pencil being sharpened.

As pencil P descends through annular portion 10, pencil P is held in axial alignment. When the tip of pencil P reaches blade 16, the blade cuts a conical surface onto pencil P. Once sharpened, pencil P can then be removed, eventually releasing lever 46 (FIGS. 10 and 11) thereby stopping motor 38.

If a cosmetic pencil was thus sharpened, the point can be applied to a person's face. Because the core of the cosmetic pencil is very soft it rapidly dulls during use. Therefore, the pencil may then be conveniently reinserted into pencil hole 22 for quick resharpening. Because the pencil is easily resharpened it can be done repeatedly to maintain an optimum point.

It is to be appreciated that various modifications may be implemented with respect to the above described, preferred embodiment. For example, the motor is shown stored below, but can be mounted to the side of the rotor in other embodiments. Also the rotor can have its axis either vertical or horizontal. In some cases the motor axis will not be coaxial with the rotor axis, in which case an appropriate bevel gear or other drive train may be used. Also in some embodiments, a drive train may be employed to change the speed of the motor so that the rotor turns either faster or slower than the motor. Also the size, rating, speed, and power of the electric motor can be selected according to the particular application. The various dimensions and illustrated shapes can be altered depending upon the desired capacity, structural rigidity, etc.

Obviously, many modifications and variations of the present invention are possible in light of the above teachings. It is therefore to be understood that within the scope of the appended claims, the invention may be practiced otherwise than as specifically described.

We claim:

1. A sharpener for a soft element pencil comprising:

a housing having a pencil hole;

a rotor rotatably mounted in said housing and having (a) a base portion, (b) an annular portion spaced from said base portion, and (c) a blade having a pair of supported ends, said base portion supporting one of said supported ends, the other one of said supported ends being supported by said annular portion, said blade being suspended without external support between said supported ends; and a drive means mounted in said housing for revolving said rotor, said blade having a skewed cutting edge that revolves around a conical axis to follow and cut a conical surface.

2. A sharpener according to claim 1 wherein said conical surface is angularly sized to accommodate a cosmetic pencil.

3. A sharpener according to claim 1 wherein said conical surface is angularly sized to accommodate an artist's pencil.

4. A sharpener according to claim 1 wherein opposite rays on said conical surface subtend an angle exceeding 30°.

5. A sharpener according to claim 1 wherein opposite rays on said conical surface subtends an angle of substantially 35°.

6. A sharpener according to claim 1 wherein said blade has a face tangent to said conical surface.

7. A sharpener according to claim 1 wherein said base portion and said annular portion are coaxial.

8. A sharpener according to claim 7 wherein said pencil hole is coaxial with said annular portion.

9. A sharpener according to claim 8 wherein said base portion and said annular portion are cylindrical.

10. A sharpener according to claim 1 wherein said annular portion is sized to encompass and guide said pencil, said rotor being arranged between said base portion and said annular portion to touch said pencil only with said blade.

11. A sharpener according to claim 10 wherein said drive means comprises a motor coupled to said rotor, said blade transferring torque between said base portion and said annular portion.

12. A sharpener according to claim 11 wherein said drive means comprises a motor coupled to said base, said base applying torque to said blade.

13. A sharpener according to claim 12 wherein said base has a socket for connecting to said motor.

14. A sharpener according to claim 1 wherein said housing comprises a cutting chamber containing said rotor, said cutting chamber having a width exceeding twice the outside diameter of said rotor.

15. A sharpener according to claim 14 wherein said housing has an access door to said cutting chamber for removing shavings.

16. A sharpener according to claim 15 wherein said housing comprises a motor chamber containing said drive means.

17. A sharpener according to claim 16 wherein said cutting chamber is above and partitioned from said motor chamber.

18. A sharpener according to claim 14 wherein said housing has an internal collar encircling said pencil hole for bearing said rotor.

19. A sharpener according to claim 1 comprising:

a switch coupled to said drive means and having an actuating arm mounted at said pencil hole.

20. A sharpener according to claim 19 wherein said actuating arm is slidably mounted at said pencil hole.

21. A sharpener according to claim 19 comprising:

a lever pivotally mounted at said pencil hole to swing against said actuating arm.

22. A sharpener according to claim 1 wherein said blade is cantilevered on said base portion.

23. A sharpener according to claim 1 wherein said blade is cantilevered on said annular portion.

24. A sharpener according to claim 1 wherein said blade is integral with said base portion and said annular portion.

25. A method for using a cosmetic pencil with a motor driven blade, comprising the steps of:

axially inserting the cosmetic pencil against the blade without twisting the cosmetic pencil after said motor begins revolving the blade to shave the cosmetic pencil at an angle appropriate for cosmetic application;

removing the cosmetic pencil and stopping the motor;

applying the cosmetic pencil facially to an individual;

restarting the motor;

reinserting the cosmetic pencil against the blade when the cosmetic pencil is dull and after the restarting of said motor; and reapplying the cosmetic pencil facially to said individual, so that the cosmetic pencil can be repeatedly sharpened in a single session with the individual without undue delays for sharpening.

26. A method according to claim 25 wherein said cosmetic pencil is sharpened into a conical surface wherein opposite rays on said conical surface subtend an angle exceeding 30°.

27. A method according to claim 25 wherein said cosmetic pencil is sharpened into a conical surface wherein opposite rays on said conical surface subtend an angle of substantially 35°.

* * * * *